US008716992B2

(12) United States Patent
Takano et al.

(10) Patent No.: US 8,716,992 B2
(45) Date of Patent: May 6, 2014

(54) CURRENT LIMITING CIRCUIT AND POWER SUPPLY CIRCUIT

(75) Inventors: Yoichi Takano, Tokyo (JP); Shinichiro Maki, Tokyo (JP); Hiroshi Nozaki, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 416 days.

(21) Appl. No.: 13/295,338

(22) Filed: Nov. 14, 2011

(65) Prior Publication Data

US 2012/0126762 A1 May 24, 2012

(30) Foreign Application Priority Data

Nov. 19, 2010 (JP) ..... 2010-258672

(51) Int. Cl.
*G05F 1/565* (2006.01)

(52) U.S. Cl.
USPC ..... 323/273; 323/908

(58) Field of Classification Search
USPC ..... 323/273, 908
See application file for complete search history.

(56) References Cited

U.S. PATENT DOCUMENTS 4,835,649 A * 5/1989 Salerno ..... 361/18
4,851,953 A * 7/1989 O'Neill et al. ..... 361/101
5,272,399 A * 12/1993 Tihanyi et al. ..... 327/379
5,289,109 A * 2/1994 Summe ..... 323/277
RE37,778 E * 7/2002 Feldtkeller ..... 323/277
8,169,202 B2 * 5/2012 Chen ..... 323/273
8,508,199 B2 * 8/2013 Arigliano et al. ..... 323/277
2003/0147193 A1 * 8/2003 Hamon et al. ..... 361/87
2003/0169025 A1 * 9/2003 Finney ..... 323/276
2008/0272753 A1 * 11/2008 Kawashima et al. ..... 323/277
2010/0320980 A1 * 12/2010 Terada et al. ..... 323/282
2012/0062198 A1 * 3/2012 Takano et al. ..... 323/282
2012/0098513 A1 * 4/2012 Terada et al. ..... 323/284
2012/0126762 A1 * 5/2012 Takano et al. ..... 323/274
2012/0187930 A1 * 7/2012 Williams et al. ..... 323/273

FOREIGN PATENT DOCUMENTS

JP 2002-304225 10/2002

* cited by examiner

*Primary Examiner* — Jeffrey Sterrett
(74) *Attorney, Agent, or Firm* — IPUSA, PLLC

(57) ABSTRACT

A current limiting circuit for limiting an output current in response to a control current includes a detection circuit to detect a detection voltage responsive to an output voltage, and a control current generating circuit to generate a control current responsive to the detection voltage, wherein the control current generating circuit includes a first transistor through which the control current flows, a second transistor that becomes conductive upon a voltage responsive to an amount of the control current being greater than a predetermined voltage above the detection voltage, and a resistor connecting between a base and an emitter of the second transistor to raise a potential at the base of the second transistor above a predetermined level, wherein the amount of the control current flowing through the first transistor decreases as an amount of a current flowing through the second transistor increases.

3 Claims, 6 Drawing Sheets

CURRENT LIMITING CIRCUIT AND POWER SUPPLY CIRCUIT

BACKGROUND OF THE INVENTION

1. Field of the Invention

The disclosures herein relate to a current limiting circuit which includes a detection circuit for detecting a detection voltage responsive to an output voltage and a control current generating circuit for generating a control current responsive to the detection voltage thereby to limit an output current in response to the control current, and also relate to a power-supply circuit having such a current limiting circuit.

2. Description of the Related Art

FIG. 3 is a drawing illustrating an example of a related-art power supply circuit. A power supply circuit 10 includes a reference voltage generating circuit 11, a bias circuit 12, a detection circuit 13, a control circuit 14, a current limiting circuit 15, and a current control transistor Q1.

The reference voltage generating circuit 11 and the bias circuit 12 are situated between an input terminal Tin and a ground terminal Tgnd. The detection circuit 13 includes resistors R5 and R6 situated between an output terminal Tout and the ground terminal Tgnd, thereby dividing an output voltage Vout appearing between the output terminal Tout and the ground terminal Tgnd. The voltage resulting from potential division by the resistors R5 and R6 is a voltage responsive to the output voltage Vout. This voltage is supplied to the control circuit 14 as a detection voltage Vs.

The control circuit 14 includes a differential amplifier circuit 21 and a transistor Q2. The non-inverted input node of the differential amplifier circuit 21 receives a reference voltage Vref from the reference voltage generating circuit 11, and the inverted input node of the differential amplifier circuit 21 receives the detection voltage Vs from the detection circuit 13.

The differential amplifier circuit 21 outputs an electric current responsive to a difference between the reference voltage Vref and the detection voltage Vs. The output current of the differential amplifier circuit 21 is supplied to a transistor Q2. The transistor Q2 is an NPN transistor.

The base of the transistor Q2 receives the output of the differential amplifier circuit 21 and the output of the current limiting circuit 15. The collector of the transistor Q2 is connected to the base of the current control transistor Q1 and to the base of a transistor Q3 that is part of the current limiting circuit 15. The emitter of the transistor Q2 is connected to the ground terminal Tgnd, so that the collector current of the transistor Q2 is converted into a voltage (i.e., I-V conversion).

In response to the outputs of the differential amplifier circuit 21 and the current limiting circuit 15, the transistor Q2 controls the potential of the bases of the current control transistor Q1 and the transistor Q3 that is part of the control circuit 14. The transistor Q1 is a PNP transistor. The current control transistor Q1 has the emitter thereof connected to the input terminal Tin, the collector thereof connected to the output terminal Tout, and the base thereof connected to the collector of the transistor Q2. The current control transistor Q1 supplies a current responsive to the collector potential of the transistor Q2 from the input terminal Tin to the output terminal Tout.

The current limiting circuit 15 includes transistors Q3 through Q6 and resistors R1 through R4. The resistors R3 and R4 are connected in series between the output terminal Tout and the ground terminal Tgnd, thereby dividing the output voltage Vout. The voltage obtained by the division is supplied to the base of a transistor Q4.

The transistor Q4 is a PNP transistor. The transistor Q4 has the base thereof connected to the joining point between the resistor R3 and the resistor R4, the emitter thereof coupled via the resistor R2 to the collector of the transistor Q3, and the collector thereof connected to the collector and base of the transistor Q5.

The transistor Q5 is an NPN transistor. The transistor Q5 has the collector thereof connected to the collector of the transistor Q4, the emitter thereof connected to the ground terminal Tgnd, and the base thereof connected to the collector of the transistor Q4 and to the base of the transistor Q6.

The transistor Q6 is an NPN transistor. The transistor Q6 has the collector thereof connected to the base of the transistor Q2, the emitter thereof connected to the ground terminal Tgnd, and the base thereof connected to the base and collector of the transistor Q5. The transistors Q5 and Q6 constitute a current mirror circuit, which pulls from the base of the transistor Q2 a current responsive to the collector current Ic4 of the transistor Q4.

The resistor R1 connects between the collector of the transistor Q3 and the ground terminal Tgnd. The transistor Q3 is a PNP transistor. The transistor Q3 has the emitter thereof connected to the input terminal Tin, the collector thereof connected to the resistors R1 and R2, and the base thereof connected to the collector of the transistor Q2. The transistor Q3 supplies a current responsive to the collector potential of the transistor Q2 to the resistor R1 and the resistor R2. The transistors Q1 and Q3 have such device areas that when the collector current of the current control transistor Q1 is Io, the collector current of the transistor Q3 is equal to Io/n.

In the power supply circuit 10, as the voltage Vt obtained by the I-V conversion of the collector current of the transistor Q3 rises to a threshold voltage of the current limiting circuit 15 that is equal to (R4/(R3+R4))Vout+Vbe4, the transistor Q4 is turned on to activate a current limiting function. Here, Vbe4 is the base-emitter voltage of the transistor Q4.

Upon the activation of the current limiting function, the output voltage Vout drops, resulting in a drop of the voltage (=R4/(R3+R4)Vout) at the joining point between the resistor R3 and the resistor R4. This arrangement is expected to provide current-to-voltage characteristics as illustrated in FIG. 4. FIG. 4 is a drawing illustrating the current-to-voltage characteristics of the related-art power supply circuit.

A power supply circuit that has a current limiting circuit expected to provide the current-to-voltage characteristics illustrated in FIG. 4 is disclosed in Japanese Patent Application Publication No. 2002-304225, for example.

In the related-art power supply circuit described above, a drop of the output voltage Vout to the ground potential results in the base potential of the transistor Q4 being at the ground potential, which places the transistor Q4 in the saturated region. As the transistor Q4 is placed in the saturated region, a parasitic device Q7 as illustrated in FIG. 5 is turned on. FIG. 5 is a drawing illustrating an example of a related-art power supply circuit that includes a parasitic device.

With the parasitic device Q7 being turned on, the current-to-voltage characteristics of the power supply circuit 10 become the characteristics as illustrated in FIG. 6, thereby failing to provide the desired characteristics illustrated in FIG. 4. FIG. 6 is a drawing illustrating the current-to-voltage characteristics of a related-art power supply circuit that includes a parasitic device.

Accordingly, it may be desirable to provide a power supply circuit and a current limiting circuit that can provide desired current-to-voltage characteristics.

SUMMARY OF THE INVENTION

According to an embodiment, a current limiting circuit for limiting an output current in response to a control current includes a detection circuit to detect a detection voltage responsive to an output voltage, and a control current generating circuit to generate a control current responsive to the detection voltage, wherein the control current generating circuit includes a first transistor through which the control current flows, a second transistor that becomes conductive upon a voltage responsive to an amount of the control current being greater than a predetermined voltage above the detection voltage, and a resistor connecting between a base and an emitter of the second transistor to raise a potential at the base of the second transistor above a predetermined level, wherein the amount of the control current flowing through the first transistor decreases as an amount of a current flowing through the second transistor increases.

According to an embodiment, a power supply circuit includes a first detection circuit to detect a first detection voltage responsive to an output voltage, a control circuit to control the output voltage to keep the output voltage constant in response to the first detection voltage, and a current limiting circuit to limit an amount of a control current to which an amount of an output current is proportional, wherein the current limiting circuit includes a second detection circuit to detect a second detection voltage responsive to the output voltage, and a control current generating circuit to generate the control current in response to the second detection voltage, wherein the control current generating circuit includes a first transistor through which the control current flows, a second transistor that becomes conductive upon a voltage responsive to an amount of the control current being greater than a predetermined voltage above the second detection voltage, and a resistor connecting between a base and an emitter of the second transistor to raise a potential at the base of the second transistor above a predetermined level, wherein the amount of the control current flowing the first transistor decreases as an amount of a current flowing through the second transistor increases.

According to at least one disclosed embodiment, desired output-current-to-output-voltage characteristics are obtained.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In embodiments disclosed herein, provision is made such that the parasitic device of the current limiting circuit is not turned on.

First Embodiment

Figure 1:
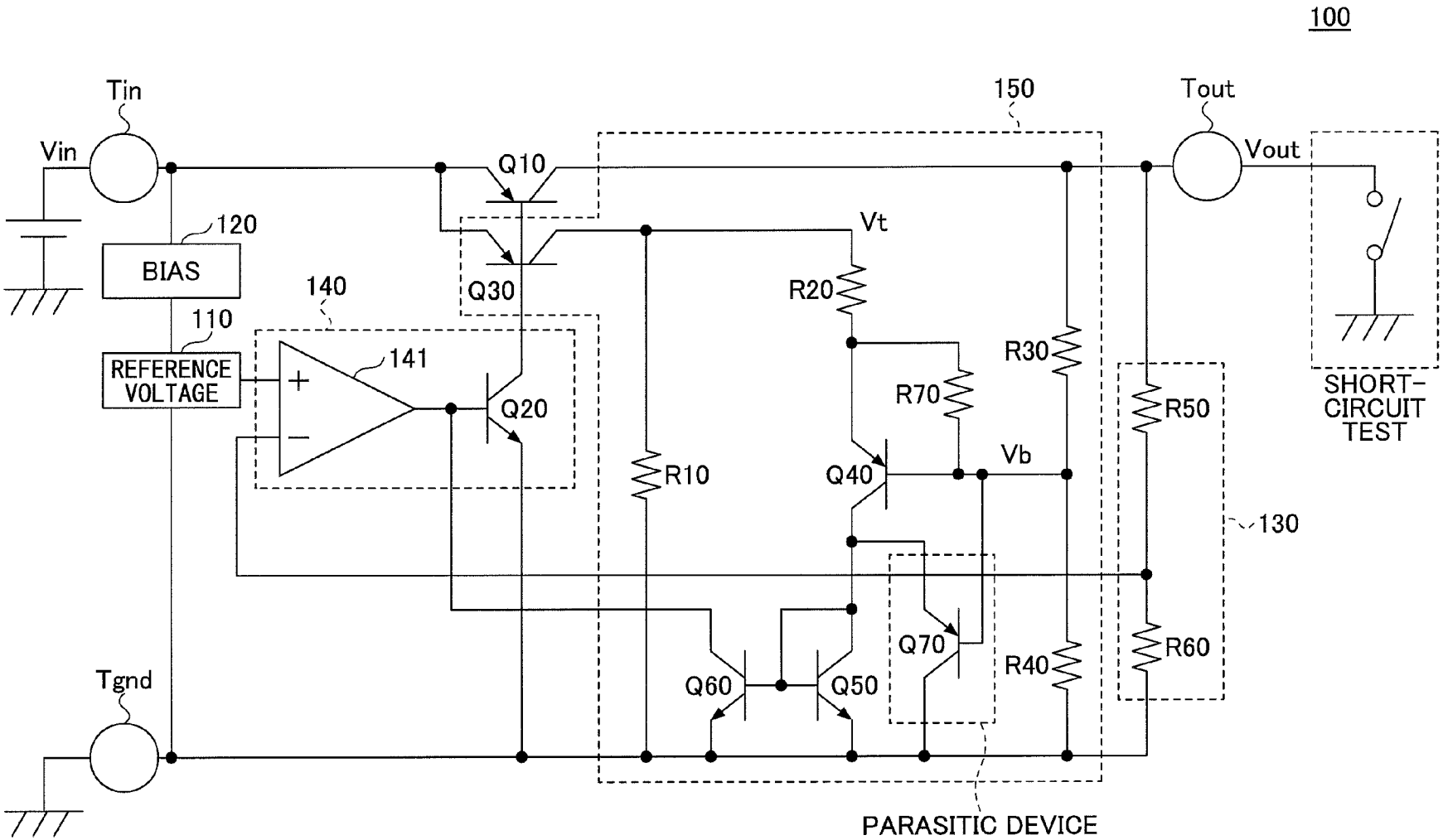
FIG. 1 is a drawing illustrating a power supply circuit according to the first embodiment.

In the following, a first embodiment will be described with reference to the accompanying drawings. FIG. 1 is a drawing illustrating a power supply circuit according to the first embodiment.

A power supply circuit 100 of the present embodiment includes a reference voltage generating circuit 110, a bias circuit 120, a detection circuit 130, a control circuit 140, a current limiting circuit 150, and a current control transistor Q10.

The reference voltage generating circuit 110 and the bias circuit 120 are situated between an input terminal Tin and a ground terminal Tgnd. The detection circuit 130 includes resistors R50 and R60 situated between an output terminal Tout and the ground terminal Tgnd, thereby dividing an output voltage Vout appearing between the output terminal Tout and the ground terminal Tgnd. The voltage resulting from potential division by the resistors R50 and R60 is a voltage responsive to the output voltage Vout. This voltage is supplied to the control circuit 140 as a detection voltage Vs.

The control circuit 140 includes a differential amplifier circuit 141 and a transistor Q20. The non-inverted input node of the differential amplifier circuit 141 receives a reference voltage Vref from the reference voltage generating circuit 110, and the inverted input node of the differential amplifier circuit 141 receives the detection voltage Vs from the detection circuit 130.

The differential amplifier circuit 141 outputs an electric current responsive to a difference between the reference voltage Vref and the detection voltage Vs. The output current of the differential amplifier circuit 141 is supplied to a transistor Q20. The transistor Q20 is an NPN transistor.

The base of the transistor Q20 receives the output of the differential amplifier circuit 141 and the output of the current limiting circuit 150. The collector of the transistor Q20 is connected to the base of the current control transistor Q10 and to the base of a transistor Q30 that is part of the current limiting circuit 150. The emitter of the transistor Q20 is connected to the ground terminal Tgnd, so that the collector current of the transistor Q20 is converted into a voltage (i.e., I-V conversion).

In response to the outputs of the differential amplifier circuit 141 and the current limiting circuit 150, the transistor Q20 controls the potential of the bases of the current control transistor Q10 and the transistor Q30 that is part of the control circuit 140. The transistor Q10 is a PNP transistor. The current control transistor Q10 has the emitter thereof connected to the input terminal Tin, the collector thereof connected to the output terminal Tout, and the base thereof connected to the collector of the transistor Q20. The current control transistor Q10 supplies a current responsive to the collector potential of the transistor Q20 from the input terminal Tin to the output terminal Tout.

The current limiting circuit 150 includes transistors Q30 through Q60 and resistors R10, R20, R30, R40, and R70. The resistors R30 and R40 are connected in series between the output terminal Tout and the ground terminal Tgnd, thereby dividing the output voltage Vout. The voltage obtained by the division is supplied to the base of a transistor Q40.

The transistor Q40 is a PNP transistor. The base of the transistor Q40 is connected to the joining point between the resistor R30 and the resistor R40 and to the resistor R70. The transistor Q40 has the emitter thereof coupled to the collector of the transistor Q30 via the resistor R20, and has the collector thereof connected to the collector and base of the transistor Q50. The resistor R70 connects between the base and emitter of the transistor Q40.

The transistor Q50 is an NPN transistor. The transistor Q50 has the collector thereof connected to the collector of the transistor Q40, the emitter thereof connected to the ground terminal Tgnd, and the base thereof connected to the collector of the transistor Q40 and to the base of the transistor Q60.

The transistor Q60 is an NPN transistor. The transistor Q60 has the collector thereof connected to the base of the transistor Q20, the emitter thereof connected to the ground terminal Tgnd, and the base thereof connected to the base and collector of the transistor Q50. The transistors Q50 and Q60 constitute a current mirror circuit, which pulls from the base of the transistor Q20 a current responsive to the collector current of the transistor Q40.

The resistor R10 connects between the collector of the transistor Q30 and the ground terminal Tgnd. The transistor Q30 is a PNP transistor. The transistor Q30 has the emitter thereof connected to the input terminal Tin, the collector thereof connected to the resistors R10 and R20, and the base thereof connected to the collector of the transistor Q20. The transistor Q30 supplies a current responsive to the collector potential of the transistor Q20 to the resistor R10 and the resistor R20. The current control transistors Q10 and the transistor Q30 have such device areas that when the collector current of the current control transistor Q10 is Io, the collector current of the transistor Q30 is equal to Io/n.

In the power supply circuit 100, as the voltage Vt obtained by the I-V conversion of the collector current of the transistor Q30 rises to the voltage (R40/(R30+R40))Vout+Vbe40, the transistor Q40 is turned on to activate a current limiting function. Namely, as the current flowing through the transistor Q40 increases, the control current flowing through the transistor Q30 decreases, and so does the output current. Here, Vbe40 is the base-emitter voltage of the transistor Q40.

Upon the activation of the current limiting function, the output voltage Vout drops, resulting in a drop of the voltage Vb at the joining point between the resistor R30 and the resistor R40 applied to the base of the transistor Q40.

In the present embodiment, the voltage Vb is represented as follows.

$$Vb=(R40/(R30+R40))\times(V\text{out}+(R30/R70)\times Vbe40)$$

When the output voltage Vout becomes 0 V, i.e., when the output is short-circuited, the voltage Vb is expressed as follows.

$$Vb=((R30\times R40)/(R30+R40))\times(Vbe40/R70)$$

In the present embodiment, the provision of the resistor R70 between the emitter and base of the transistor Q40 produces a constant current equal in amount to Vbe40/R70. This constant current is supplied to the joining point between the resistor R30 and the resistor R40 to raise the voltage Vb. The rise of the voltage Vb prevents the parasitic device Q70 from being turned on in response to a drop in the potential at the base of the parasitic device Q70 below the threshold voltage.

Figure 4:
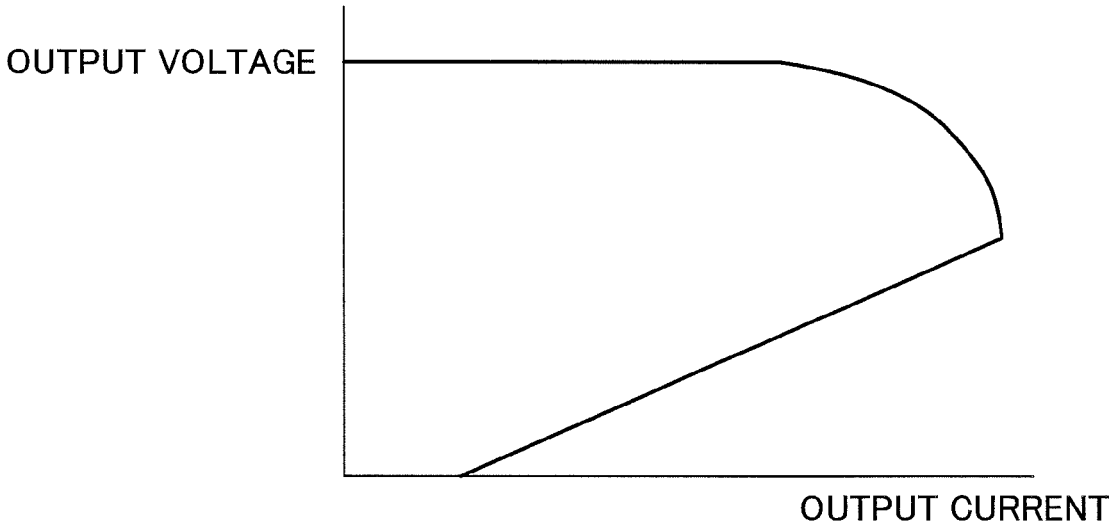
FIG. 4 is a drawing illustrating the current-to-voltage characteristics of the related-art power supply circuit.
Figure 5:
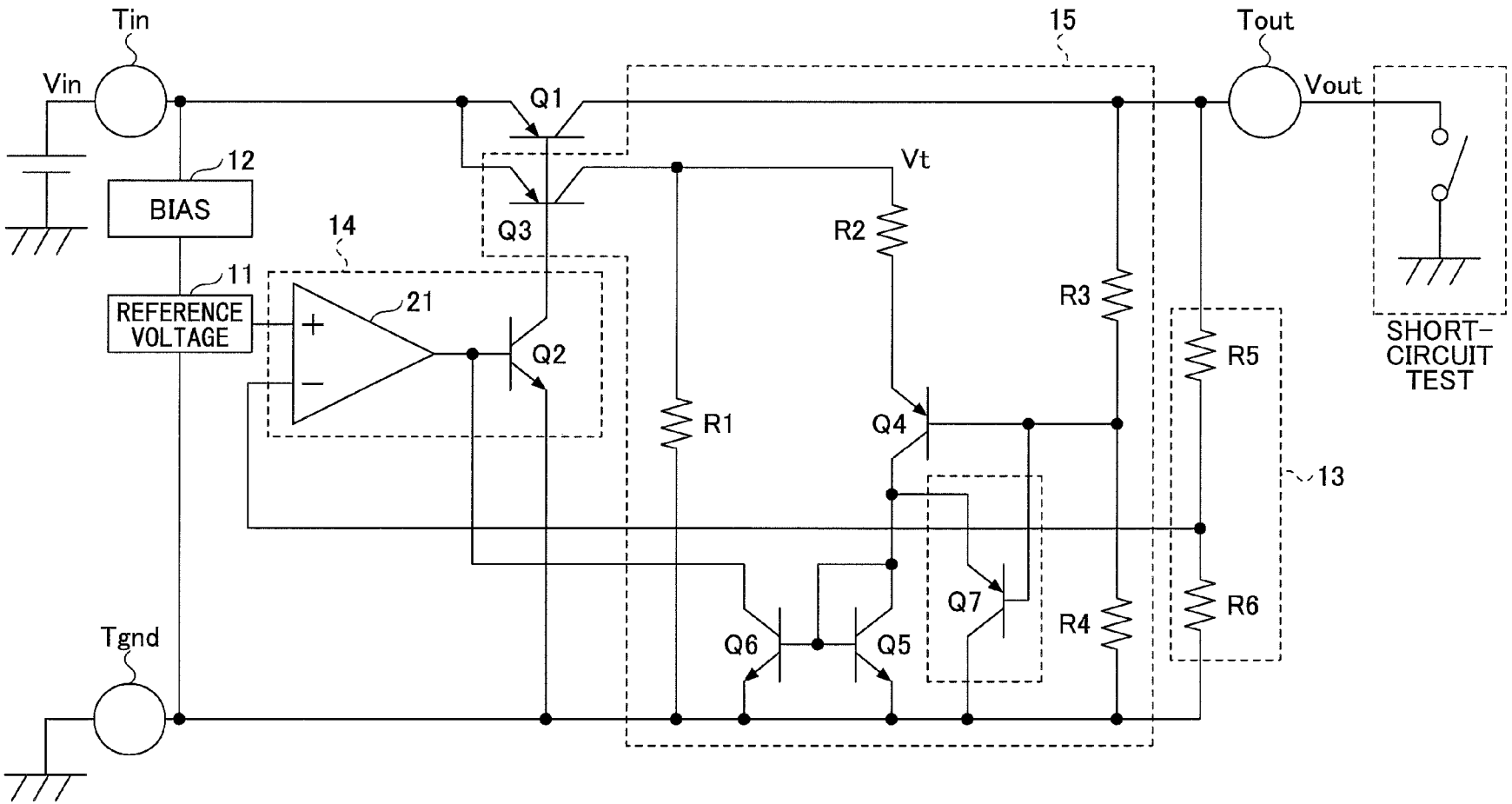
FIG. 5 is a drawing illustrating an example of a related-art power supply circuit that includes a parasitic device.
Figure 6:
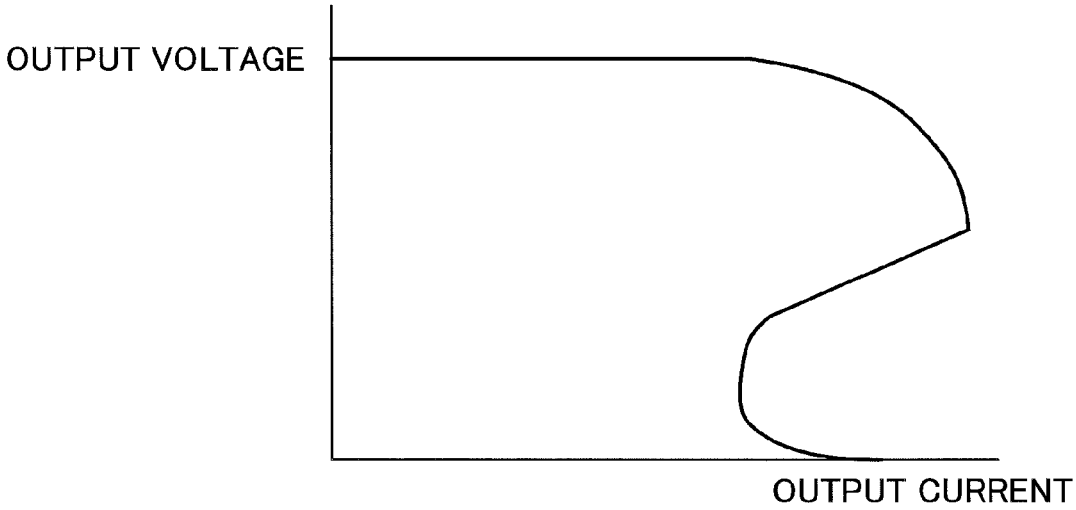
FIG. 6 is a drawing illustrating the current-to-voltage characteristics of the related-art power supply circuit that includes a parasitic device.

According to the present embodiment described above, a simple configuration prevents the parasitic device Q70 from being turned on, thereby providing the desired current-to-voltage characteristics as illustrated in FIG. 4.

In the present embodiment, the use of a lateral PNP transistor serves to simplify the configuration of a transistor, and, at the same time, the parasitic device Q70 resulting from the use of the lateral PNP transistor is kept turned off.

Second Embodiment

In the following, a second embodiment will be described with reference to the accompanying drawings. The second embodiment differs from the first embodiment only in that a diode is provided in the current limiting circuit for the purpose of improving the temperature characteristics of transistors. In the description of the second embodiment in the following, differences from the first embodiment are only described. The same or similar elements as those of the first embodiment are referred to by the same or similar reference symbols, and a description thereof will be omitted.

Figure 2:
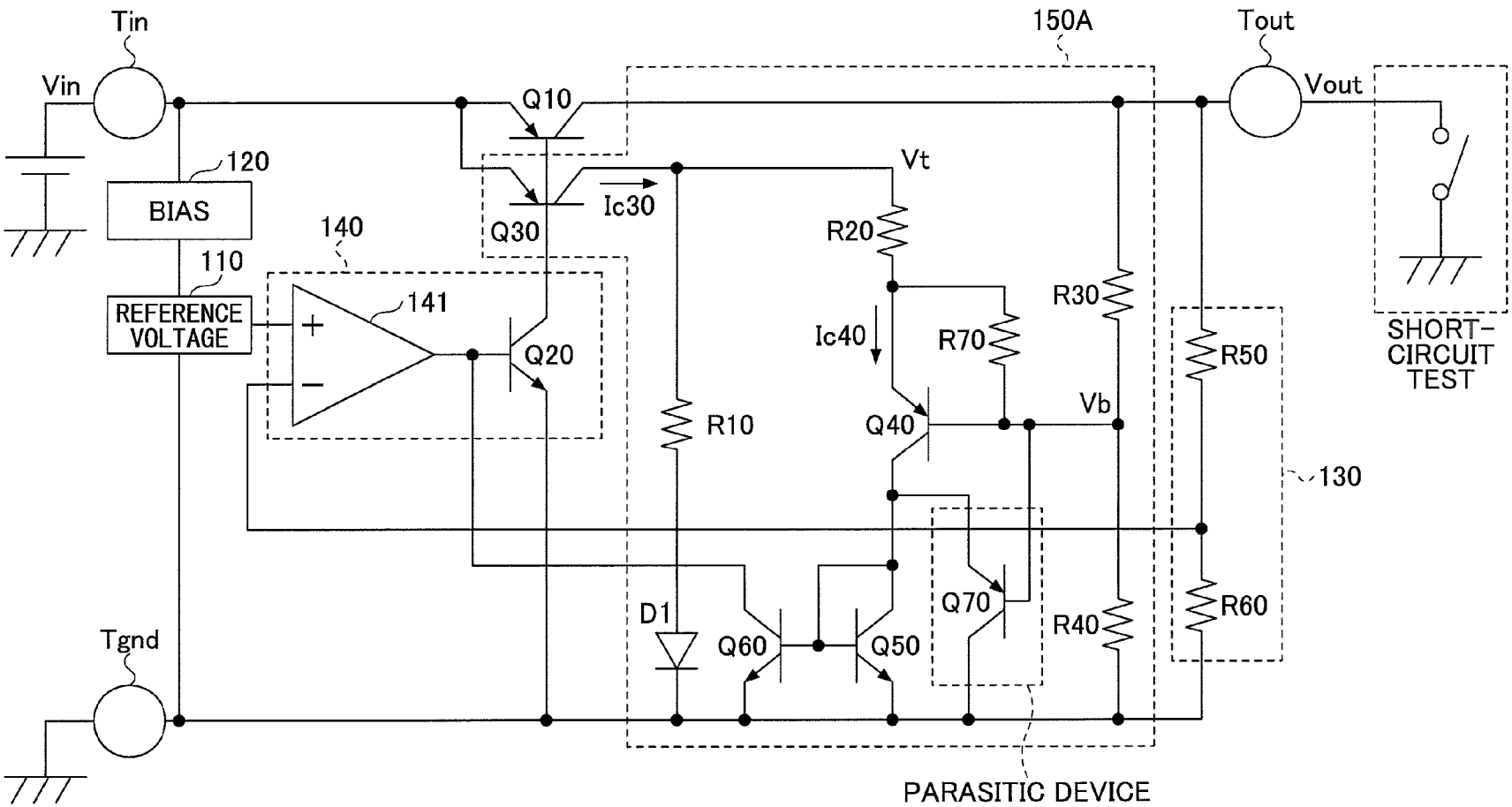
FIG. 2 is a drawing illustrating a power supply circuit according to the first embodiment.
Figure 3:
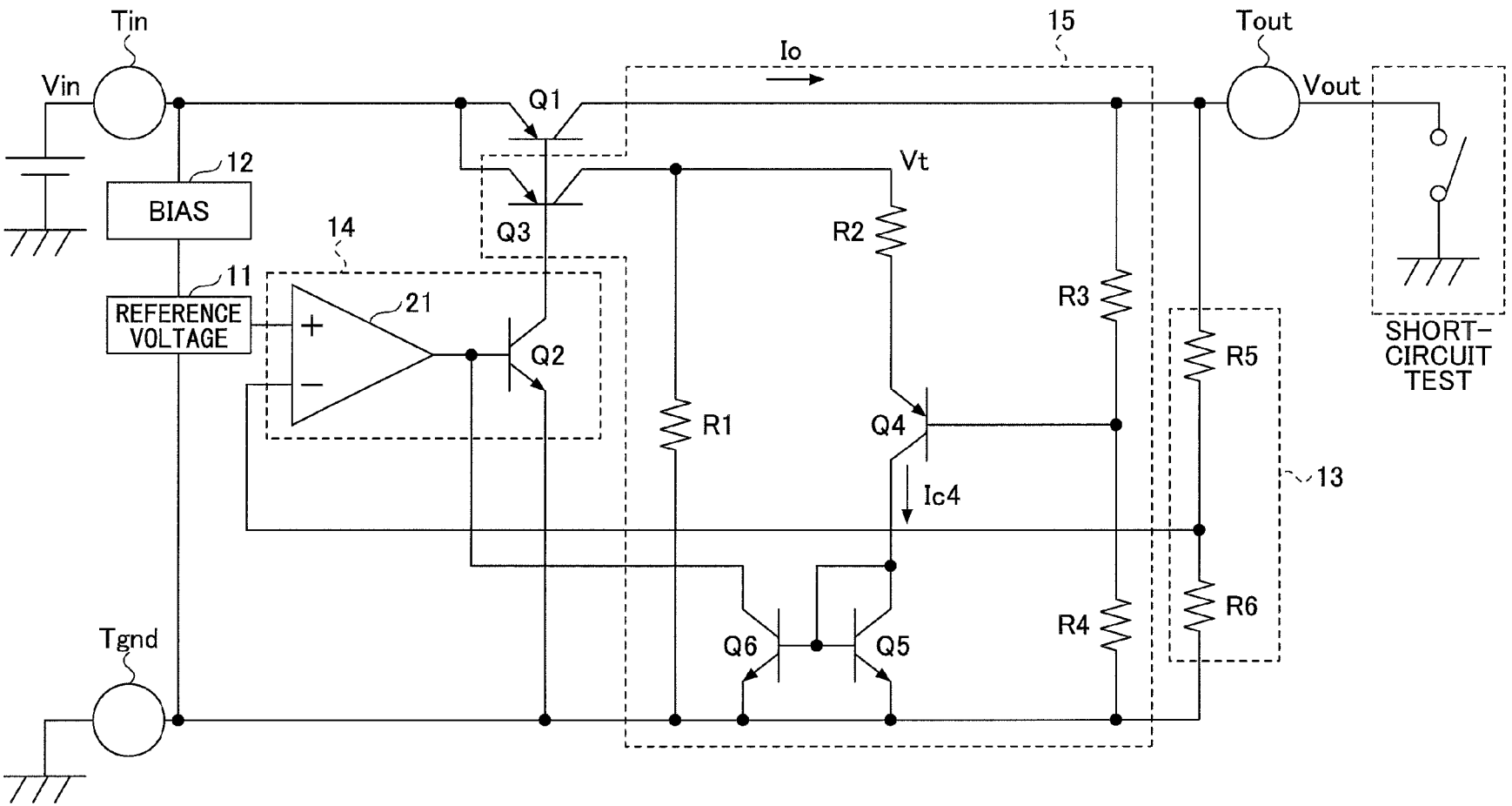
FIG. 3 is a drawing illustrating an example of a related-art power supply circuit.

FIG. 2 is a drawing illustrating a power supply circuit according to the second embodiment.

A power supply circuit 100A of the present embodiment includes a current limiting circuit 150A. The current limiting circuit 150A of the present embodiment includes a diode D1 arranged between the resistor R10 and the ground terminal Tgnd. The diode D1 serves to compensate for temperature with respect to the collector current Ic40 of the transistor Q40.

The threshold voltage Vt at which the current limiting function of the current limiting circuit 150A is activated is expressed as follows.

$$Vt=(R40/(R40+R30))\times V\text{out}+Vbe40$$

Further, a voltage Vt1 detected by the current control transistor Q10 and the transistor Q30 is expressed as follows.

$$Vt1=VD1+R10\times Ic30$$

Here, VD1 is the forward voltage of the diode D1, and Ic30 is the collector current of the transistor Q30.

The temperature characteristics of the forward voltage VD1 of the diode D1 and the temperature characteristics of the base-emitter voltage Vbe40 of the transistor Q40 cancel each other. The present embodiment thus improves the temperature characteristics of the current limiting circuit 150A.

Further, the present invention is not limited to these embodiments disclosed herein, but various variations and modifications may be made without departing from the scope of the present invention.

The present application is based on Japanese priority application No. 2010-258672 filed on Nov. 19, 2010, with the Japanese Patent Office, the entire contents of which are hereby incorporated by reference.

What is claimed is:

1. A current limiting circuit for limiting an output current in response to a control current, comprising:

a detection circuit to detect a detection voltage responsive to an output voltage; and a control current generating circuit to generate a control current responsive to the detection voltage, wherein the control current generating circuit includes:

a first transistor through which the control current flows;

a second transistor that becomes conductive upon a voltage responsive to an amount of the control current being greater than a predetermined voltage above the detection voltage; and a resistor connecting between a base and an emitter of the second transistor to raise a potential at the base of the second transistor above a predetermined level, wherein the amount of the control current flowing through the first transistor decreases as an amount of a current flowing through the second transistor increases.

2. The current limiting circuit as claimed in claim 1, further comprising:

a voltage-conversion-purpose resistor to convert the control current into a voltage; and a diode connected in series to the voltage-conversion-purpose resistor, wherein the voltage-conversion-purpose resistor and the diode are arranged between a collector of the first transistor and a ground terminal.

3. A power supply circuit, comprising:

a first detection circuit to detect a first detection voltage responsive to an output voltage;

a control circuit to control the output voltage to keep the output voltage constant in response to the first detection voltage; and a current limiting circuit to limit an amount of a control current to which an amount of an output current is proportional, wherein the current limiting circuit includes:

a second detection circuit to detect a second detection voltage responsive to the output voltage; and a control current generating circuit to generate the control current in response to the second detection voltage, wherein the control current generating circuit includes:

a first transistor through which the control current flows;

a second transistor that becomes conductive upon a voltage responsive to an amount of the control current being greater than a predetermined voltage above the second detection voltage; and a resistor connecting between a base and an emitter of the second transistor to raise a potential at the base of the second transistor above a predetermined level, wherein the amount of the control current flowing the first transistor decreases as an amount of a current flowing through the second transistor increases.

* * * * *